United States Patent [19]

Brandt

[11] 3,938,462

[45] Feb. 17, 1976

[54] BOAT MOORING APPARATUS

[76] Inventor: Bertil Brandt, 6, Rue Alfred de Vigny, Paris, France

[22] Filed: Mar. 26, 1974

[21] Appl. No.: 454,987

[30] Foreign Application Priority Data

Mar. 27, 1973 Sweden ..... 7304277

[52] U.S. Cl. ..... 114/230

[51] Int. Cl.[2] ..... B63B 21/00

[58] Field of Search..... 114/230, 231, 219, 235 R, 114/77 R; 61/48, 46; 254/77, 78, 79

[56] References Cited

UNITED STATES PATENTS

| | | | |
|---|---|---|---|
| 3,155,069 | 11/1964 | Ross et al. | 114/230 |
| 3,187,706 | 6/1965 | Ross | 114/230 |
| 3,307,514 | 3/1967 | Young | 114/230 |
| 3,592,442 | 7/1971 | Zumbo | 254/77 |
| 3,763,816 | 10/1973 | Wilson | 114/230 |
| 3,783,816 | 1/1974 | Chassy et al. | 114/230 |

*Primary Examiner*—Trygve M. Blix
*Assistant Examiner*—Charles E. Frankfort
*Attorney, Agent, or Firm*—Pollock, Vande Sande & Priddy

[57] ABSTRACT

Apparatus for mooring boats and being of the type which fixedly secures one end of the boat while simultaneously preventing pivoting of the boat about said one end in response to wind and wave forces acting on the boat. A fixed support platform is provided which includes a pair of spaced support elements, and at least one stretchable elastic member is supported between the spaced support elements. In the mooring of the boat, one end of the boat is positioned against the elastic members, and thereafter a plurality of lines are attached to opposite sides of the boat at points located remotely from said one end of the boat. The latter lines are placed in tension and are so orientated relevant to the boat that force components are provided which act parallel to the longitudinal axis of the boat and resiliently urge the boat against the elastic members so as to distend the member and provide a recess therein for embracing and fixedly securing said one end of the boat. Simultaneously, the tensioned lines provide force components acting transversely of the longitudinal axis of the boat to prevent pivoting of the boat about its first end.

3 Claims, 8 Drawing Figures

BOAT MOORING APPARATUS

BRIEF DESCRIPTION OF THE INVENTION

This invention relates to a method of mooring boats to a landing structure or the like by means of elastic stretch members, and also relates to mooring means.

The invention relates in the first place to the mooring of small boats, i.e., boats of up to about 10 tons. The mooring of such boats has been carried out in several different ways, and in the following some of the most common methods are briefly described.

BACKGROUND OF THE INVENTION

The swing mooring method, i.e., a method by which the bow of the boat is tied to a buoy, is probably the method being least damaging for the boat. The boat direction follows the wind direction. This method presupposes the possibility of reaching the boat, e.g., in a small dinghy. In a heavy sea, this may involve a risk. Further, when approaching the buoy, it may be difficult sometimes to catch the buoy. This method requires much space, and the boats and buoys may at times obstruct maritime traffic.

A good method of mooring a boat is to moore the bow to a buoy and the stern to a landing structure, for example by means of cross-mooring. Different methods, more or less practicable, are used for hauling the boat to the landing structure, for approaching and mooring. This method provides greater safety in embarking and disembarking, compared with the first-mentioned method, but swells and high seas must all the same be taken into account. Lately,mooring booms have come into use which project in long rows from both sides of a landing structure. The booms are often mounted pivotally onto the landing structure, and their outer end is supported on a floating body. The booms and the boat will thereby follow the movement of the water. The mooring ropes at the outer ends of the booms are only short rope pieces and, consequently, render the mooring unelastic and jerky. It may, therefore, at heavy cross-wind happen that the booms break and the boats are damaged. Floating landing structures and mooring booms are a relatively heavy investment, and it is, therefore, important to position the boats as close to each other as possible. Boom mooring is, therefore, unsuitable for sailing boats and also for larger power boats. As the boats do not move simultaneously, but with differences in time of some tenth of a second, the masts of the boats may hook one into the other. A further factor restricting the use of mooring booms is that all boats at one landing structure ought to have about equal size so as to have the same windage.

SUMMARY OF THE INVENTION

These restrictions and drawbacks are eliminated by the present invention, which is characterized in that the boat is held in place by resilient stretch members extending athwart the longitudinal direction of the boat and being elastic in its longitudinal direction, by which members only the bow and/or stern of the boat is moored, and that the boat is pressed against said members by at least one additional mooring means on each side of the boat. The mooring means according to the invention is characterized in that stretch members being elastic in the longitudinal direction of the boat are arranged athwart the longitudinal direction of the boat and capable of securing and mooring only the bow and/or stern of the boat, and at least one additional mooring means is provided on each side of the boat for pressing the boat against said resilient stretch members.

According to preferred embodiments of the invention, the resilient stretch members extend between two landing elements projecting from the base landing structure. Said members are disposed on the same level and/or on different levels and preferably consist of strong rubber bands. For safety reasons, for example two such bands may be arranged on the same level one after the other. At a fixed landing structure, it may be necessary to arrange several bands one above each other, in view of possible variations in the water level. Several bands above each other may also be desirable at a floating landing structure when the boat load is expected to vary considerably.

The additional mooring means may be resilient or non-resilient and may, for example, consist of nylon ropes or steel wires. In order to facilitate the mooring, they are hung on a suspension device, for example a hook, which is easily accessible. This accessibility may be further improved, if the projecting landing elements are extended by means of vertically adjustable rigid members, at the ends of which further mooring means are provided, possibly suspended on a hook, in such a manner, that the rigid members in normal position, i.e., resting position, are inclined outwardly and upwardly.

By providing the projecting landing elements with angular lever means, at the end of which the mooring rope is fastened, the boat after its mooring may be secured further by turning the lever, which is mounted pivotally. The lever may then be locked in this position.

BRIEF DESCRIPTION OF THE DRAWINGS

The invention is described in greater detail in the following, with reference to the attached drawings in which.

DETAILED DESCRIPTION OF THE PREFERRED EMBODIMENTS

Figure 1:
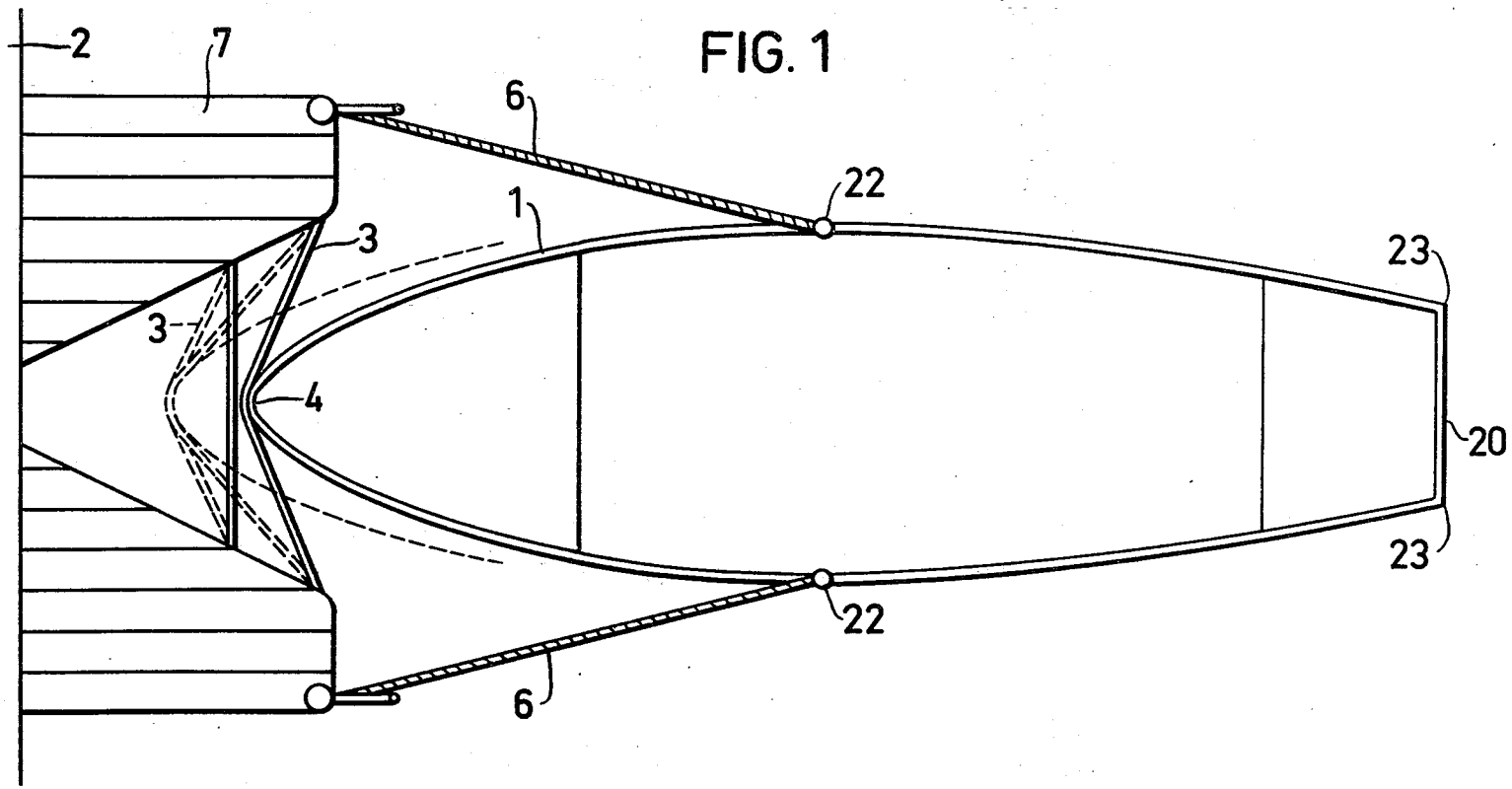
FIG. 1 is a view seen from above of one embodiment of the invention

FIG. 1 shows a boat 1 moored to a base landing structure 2, which is provided with two projecting landing elements 7. Between said elements two resilient stretch members 3 in the form of rubber bands are povided which are 8 cm wide and 6 mm thick. The boat is driven againt the stretching members 3 and moored to ropes 6. The windward rope is fastened first, and the leeward rope thereafter. The position of the boat and of the resilient stretching members in fully stretched state are indicated by dotted lines. When mooring the boat at its bow, one pressure point at 4 and two draw-points at 22 are obtained. When mooring the boat at its stern, two pressure points at 23 and two draw-points at 22 are obtained.

Figure 3:
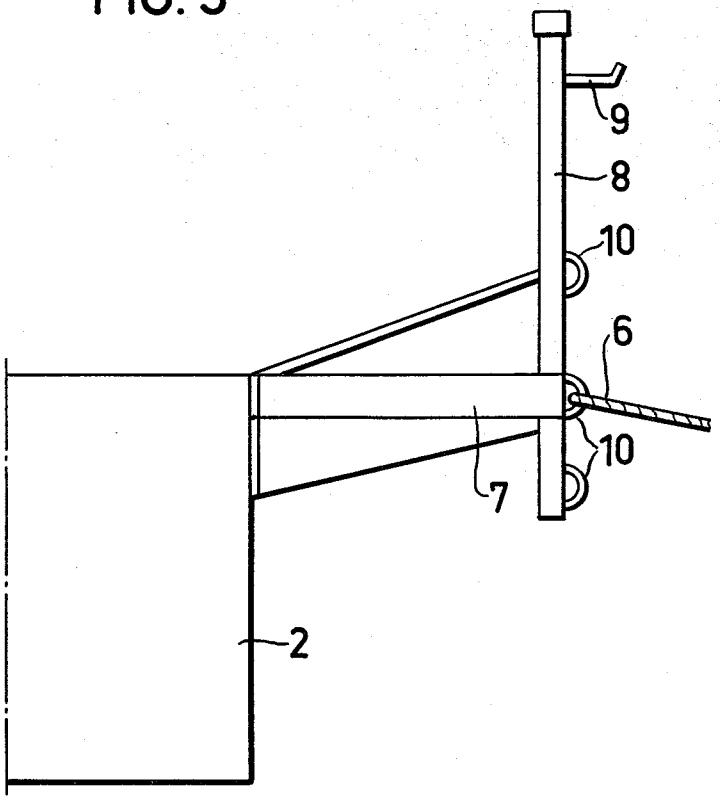
FIGS. 2 and 3 are a view of the side of the landing structure and, respectively, a lateral view along the edge of the landing structure according to another embodiment of the invention.
Figure 2:
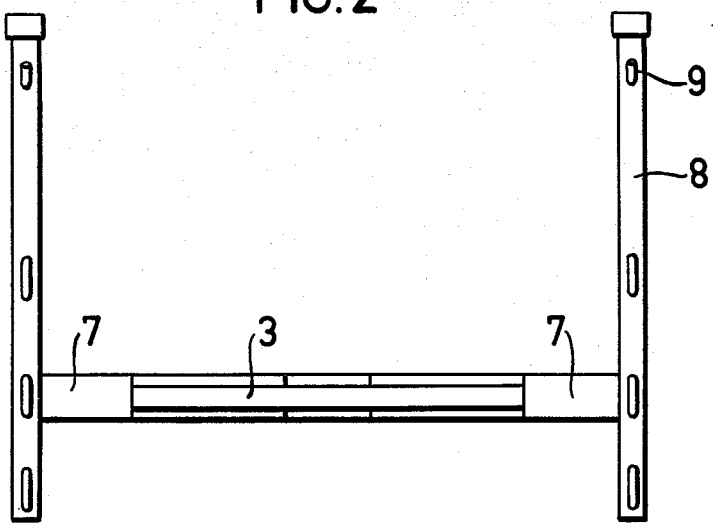

FIGS. 2 and 3 show the base landing structure 2 with projecting landing elements 7. At the end of the projecting landing element 7 an upright post 8 is provided, which carries a suspension means 9 for the mooring rope 6. Said rope 6 is secured in a loop 10, and three loops are arranged on different levels for being able to vary the mooring height. FIG. 2 shows also the resilient stretching member 3.

Figure 5:
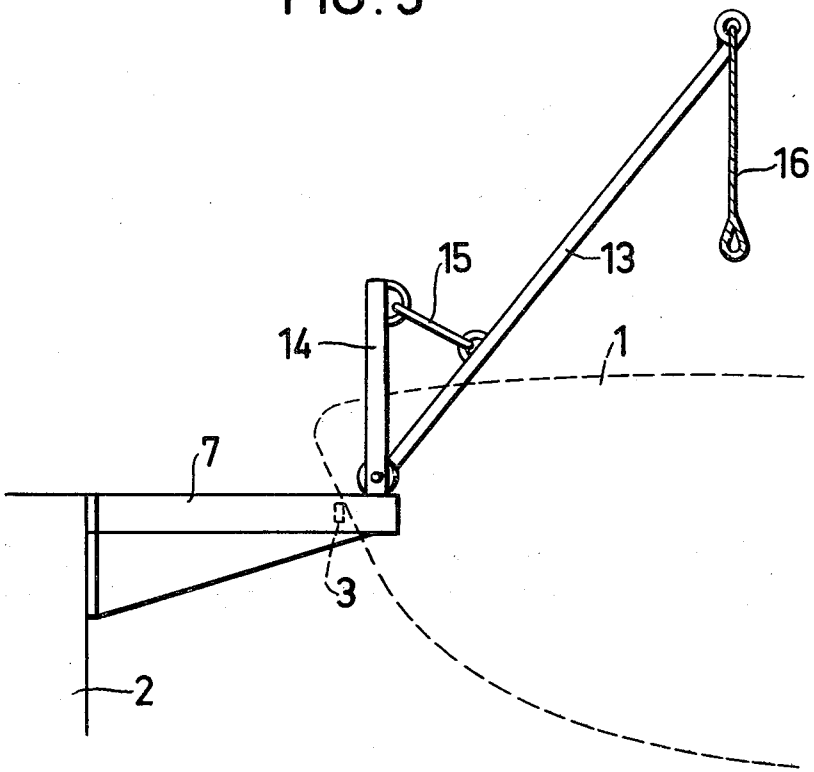
FIGS. 4 and 5 are a view of the side of the landing structure and, respectively, a lateral view along the edge of the landing structure according to still another embodiment of the invention.
Figure 4:
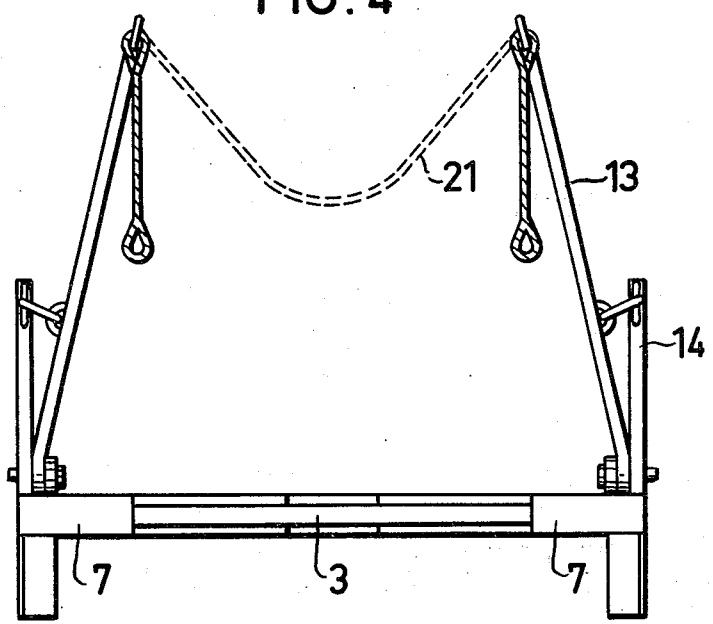

FIGS. 4 and 5 show the base landing structure 2 with projecting landing elements 7 and resilient stretching members 3. The suspension means for the rope 16 shown here is particularly suitable for single-handed mooring of a boat. The rigid arm 13, which may be said to be an extension of the projecting landing element 7, renders possible at the same time both the hanging-up and mooring of the rope 16. The upright post 14 is fixed in vertical position and the rubber band 15 holds the arm 13 in an outwardly-upwardly inclined position at rest. In secured position, when the 13 is substantially horizontal, the rubber band 15 increases the stability of the resilient mooring. The rope 16, in this way, is very easily accessible and, even when one is alone in the boat, one can easily approach a landing structure and moor. As an alternative the mooring means 16 may be replaced by the rubber band 21, which may be stretched across the stern of the boat or some deckhouse or a projecting part of the boat. The arms 13 will also in this case assume an almost horizontal position.

Figure 6:
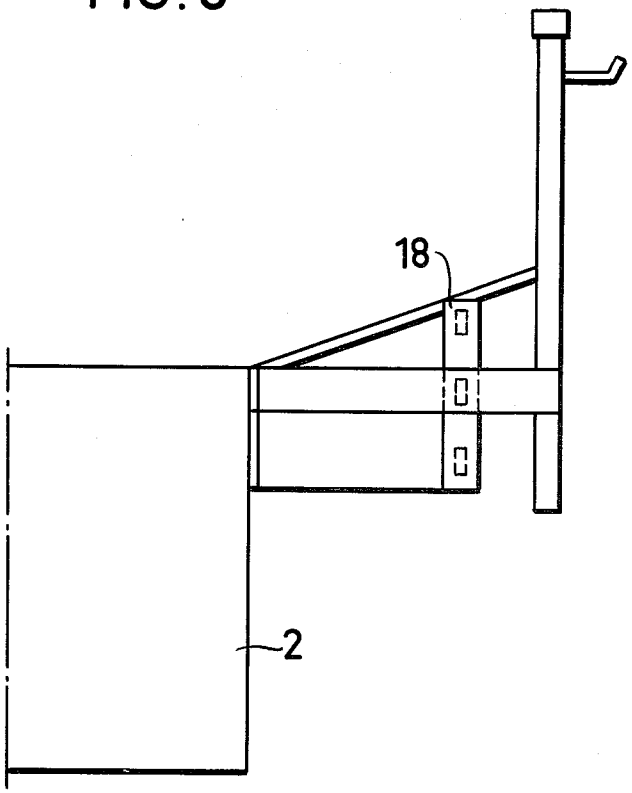
FIGS. 6 and 7 are a view of the side of the landing structure and, respectively, a lateral view along the edge of the landing structure according to still another embodiment of the invention.
Figure 7:
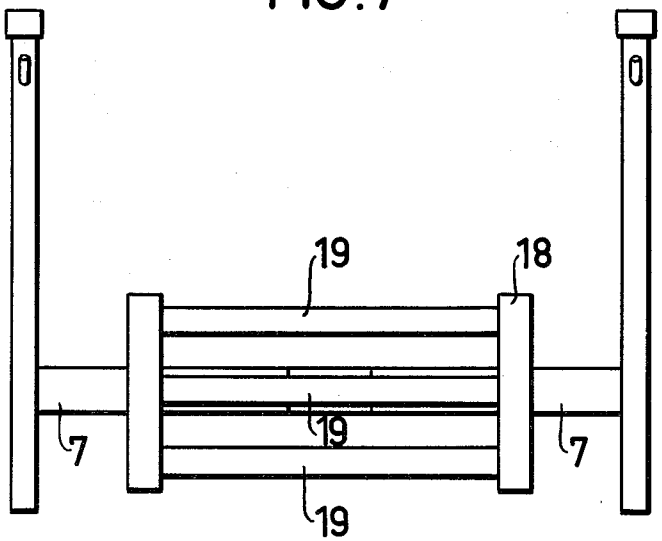

FIGS. 6 and 7 show the base landing structure 2 with projecting landing elements 7. In this embodiment, the resilient stretching members 19 are applied one above each other and mounted in holders 18 on the side. The holder 18 may be supported pivotally in order to be adjustable to different bow or stern profiles. This embodiment is particularly adapted for fixed landing structures at which the water level may vary considerably.

Figure 8:
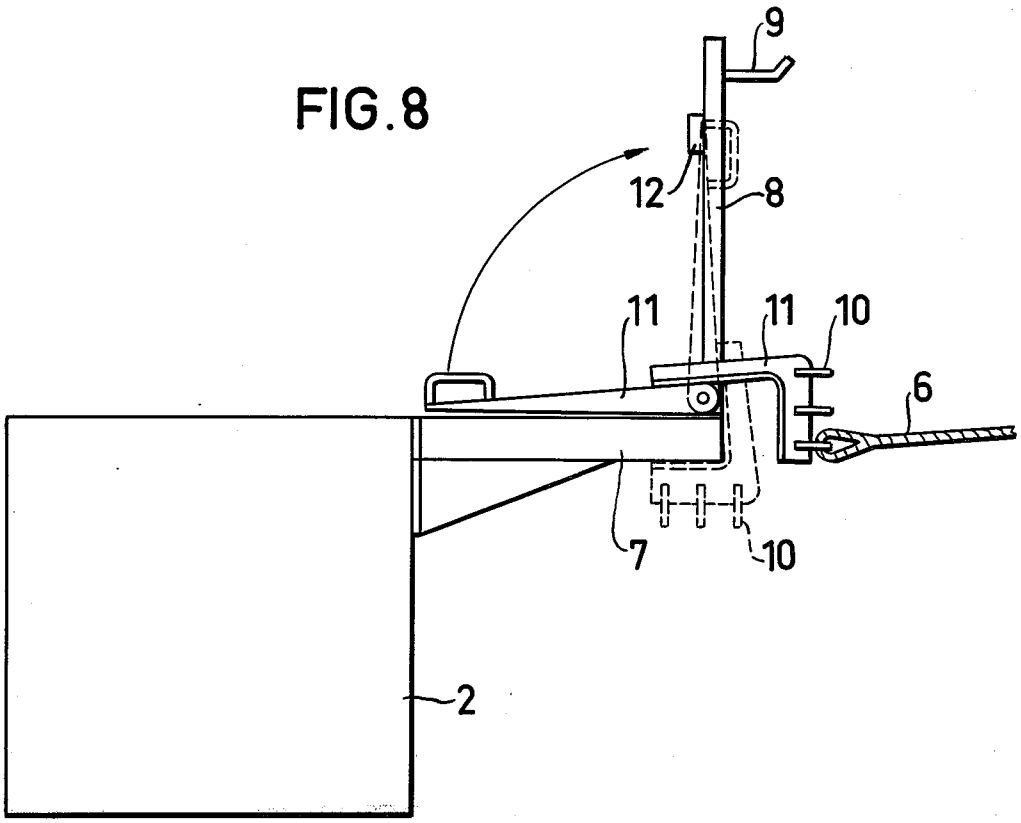
FIG. 8 is a side view along the edge of the landing structure according to an additional embodiment of the invention.

FIG. 8 shows how the mooring rope 6 may be stretched after the boat has been moored in a provisional manner and one has disembarked. The rope 6 is attached to the end of an angular lever 11, which is pivotally supported. When the lever 11 is in a horizontal position, the rope 6 is only partially stretched. The lever being in a vertical position, the rope 6 is finally stretched (dotted position in the drawing). The degree of stretching can be adjusted as the rope 6 can be attached to different loops 10. The lever means 11 can be locked in the vertical position at 12.

What I claim is:

1. Apparatus for mooring boats and being of the type which fixedly secures one end of the boat while simultaneously preventing pivoting of the boat about said one end in response to wind and wave forces acting on the boat comprising:

a fixed support platform including a pair of spaced support elements, said support elements being rigidly affixed to said support platform at least one stretchable elastic member supported between said spaced support elements and against which said one end of the boat is positioned upon mooring and with the logitudinal axis of the boat at approximately a right angle to said elastic member, a pair of support members mounted on said support elements and positioned so as to respectively lie on opposite sides of said boat and with a spacing therebetween greater than the maximum expected beam of a boat to be moored at said apparatus, and lines extending under tension from each of said support members to said boat on opposite sides thereof and at locations remote from said one end of said boat to provide force components which respectively act parallel to the longitudinal axis of the boat to resiliently urge said one end of the boat against said at least one elastic member to thereby distend said member and provide a recess therein for embracing and fixedly securing said one end of the boat while simultaneously the force components acting transversely of said longitudinal axis prevent pivoting of the boat with respect to said fixed support platform about its said one end.

2. The apparatus of claim 1 which further includes a pivotable support for each said support member and resilient support means for manually holding each of said support members in a position extending upwardly and also outwardly toward the moored boat to facilitate convenient access to said lines during the mooring of the boat, said resilient support means permitting pivoting of said support members downwardly and towards the boat as said lines are placed in tension.

3. The mooring apparatus of claim 1 which further includes means for each said line operable to a condition to cause the tentioning of the respective line.

* * * * *